United States Patent [19]

Agata

[11] Patent Number: 4,752,144

[45] Date of Patent: Jun. 21, 1988

[54] RECIPROCATIVE TYPING CONTROL SYSTEM

[75] Inventor: Kazuhiro Agata, Osaka, Japan

[73] Assignee: NEC Home Electronics Ltd., Osaka, Japan

[21] Appl. No.: 23,971

[22] Filed: Mar. 11, 1987

Related U.S. Application Data

[63] Continuation of Ser. No. 718,389, Apr. 1, 1985, abandoned.

[30] Foreign Application Priority Data

Mar. 30, 1984 [JP] Japan ..... 59-62842

[51] Int. Cl.[4] ..... B41J 19/50; B41J 19/58

[52] U.S. Cl. ..... 400/323; 400/306

[58] Field of Search ..... 400/320, 328, 322, 323, 400/303, 306

[56] References Cited

U.S. PATENT DOCUMENTS 4,169,683 10/1979 Bernardis et al. ..... 400/323

4,210,404 7/1980 Hanger ..... 400/306

4,213,714 7/1980 Jones et al. ..... 400/306

4,284,362 8/1981 Jackson et al. ..... 400/323

4,343,012 8/1982 Knapp ..... 400/323

FOREIGN PATENT DOCUMENTS 58-7374 1/1983 Japan ..... 400/303

*Primary Examiner*—William Pieprz

*Attorney, Agent, or Firm*—Cushman, Darby & Cushman

[57] ABSTRACT

A reciprocative typing control system in which a typing head is driven reciprocally for typing letters at periodic separations in response to a typing signal A following a delay D. A timing signal is produced each time the head is driven by a predetermined distance less than the letter separation and the timing signals counted. In the forward direction a typing signal is produced when the count equals the number of timing signals totaling the separation. In the backward direction the typing signal is produced when the count plus the number of timing signals in delay D equals the number of timing signals totaling the separation.

2 Claims, 3 Drawing Sheets

RECIPROCATIVE TYPING CONTROL SYSTEM

This is a continuation of application Ser. No. 718,389, filed Apr. 1, 1985, which was abandoned upon the filing hereof.

BACKGROUND OF THE INVENTION

This invention relates to a control for typing timing in a reciprocative typing system.

A typing unit or apparatus is an end unit for printing out the processed result in data processors such as a personal computers, work processors, and the like. The need for such devices has quickly developed as office automation has spread. A need exists to improve the typing speed by improving process speed in the data processor.

Reciprocative typing mechanisms for typing the letter in reciprocal motion improve typing speed. Conventionally, reciprocative typing units are designed so that typing timing signals are generated in response to a distance between typings by a linear scale mounted along a travelling path of an encoder or typing head rotatable through an angle of 360° in one reciprocal motion in association with movement of the typing head. Each letter is typed in response to a typing timing signal. A time lag to some extent is, however, inevitably produced between the signal and the typing due to characteristics of the typing head. As a result and as shown in FIGS. 1 and 2, even if the typing timing signal is generated when the head is at a position A the actual typing is made at a position A $+\alpha$ ahead of A due to mechanical delay. Similarly, when the typing timing signal is generate at A in rearward movement typing occurs at a point A$-\alpha$. Unless compensated this produces typing with dots in different lines offset from each other different in to-and-fro motion. The conventional reciprocative typing apparatus has been therefore adapted to provide the typing timing signal earlier by an interval of $\alpha$, thereby mating each dot in forward direction with a corresponding dot in rearward direction.

The reciprocative typing apparatus as described above must be adjusted from time to time to alter letter spacing. However, adjustment in the forward direction produces incorrect typing positions in the rearward direction.

It is, therefore, an object of the invention to provide a reciprocative typing control system in which adjustment of typing spacing in reciprocation is automatic.

To this end, in the reciprocation typing control system according to the invention typing timing signals are generated at intervals shorter than the distance between the positions where typing is made, and the positions where type signals are delivered in to-and-fro motion can shift apart to adjust spacing between characters as desired.

DETAILED DESCRIPTION OF THE INVENTION

Figure 1:
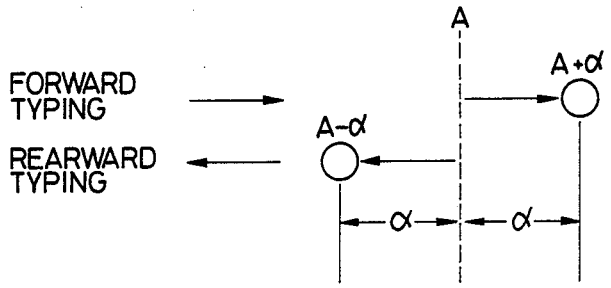
FIG. 1 PRIOR ART
FIGS. 1 and 2 explain movement of a conventional typing head in to-and-fro typing motion.
Figure 2:
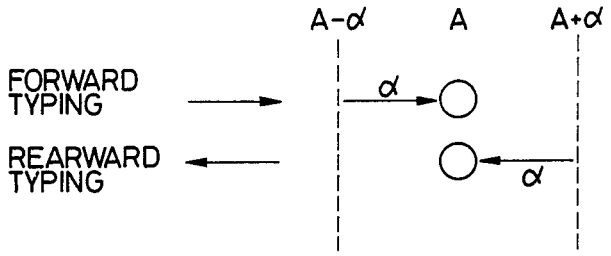
FIG. 2 PRIOR ART
Figure 3:
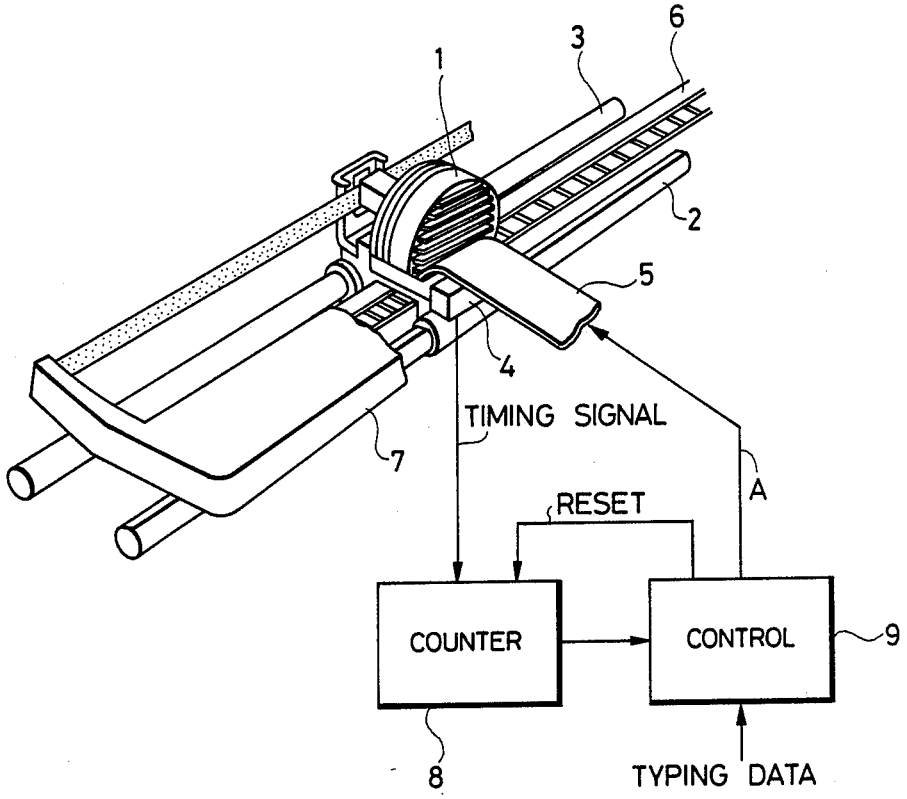
FIG. 3 is a fragmentary perspective view of a reciprocative typing apparatus with a reciprocative typing control system according to the invention.

FIG. 3 is a fragmentary perspective view showing a reciprocative typing control system according to the invention. In FIG. 3, numeral 1 designates a conventional typing head which is guided by a linear scale 2 and a guide shaft 3 mounted in parallel with a platen (not shown) for its longitudinal travel and which types letters and the like on a paper (not shown) rolled on the platen. In this instance, the position of the linear scale relative to a conventional sensor 4 disposed on a slider which supports typing head 1 generates a typing timing signal, for instance, every 1/720 inch and delivers that signal to counter 8. Flat type cable 5 transmits a type signal to the typing head 1 from control 9, and belt 6 connects typing head 1 to a head moving motor (not shown). An ink ribbon cassette 7 serves to pay out a typing ribbon between typing head 1 at its top end and typing paper.

Operation of the instant apparatus as described above will be explained with reference to a flow chart shown in FIG. 4. When the power is turned on the motor for moving the typing head is driven to convey the typing head 1 by the belt 6 to a home position. Next, typing information is supplied from an information processor control 9 to have the aforementioned typing head moving motor drive the belt so that the typing head 1 is moved forwardly at a constant speed. As a result, typing timing signals are emitted each time the head is moved by a given interval, for example, at every 1/720 inch. This distance is shorter than the distance between adjacent character and the signals are accumulated in a conventional counter 8.

Figure 5:
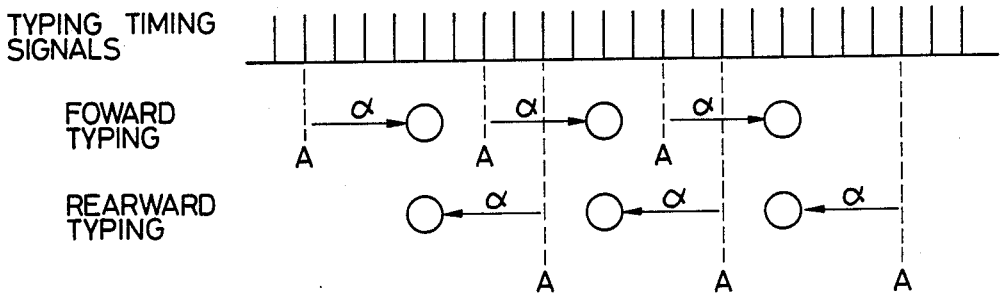
FIG. 5 is a representation explanatory of movement of the typing head to which the present invention is applied.
Figure 4:
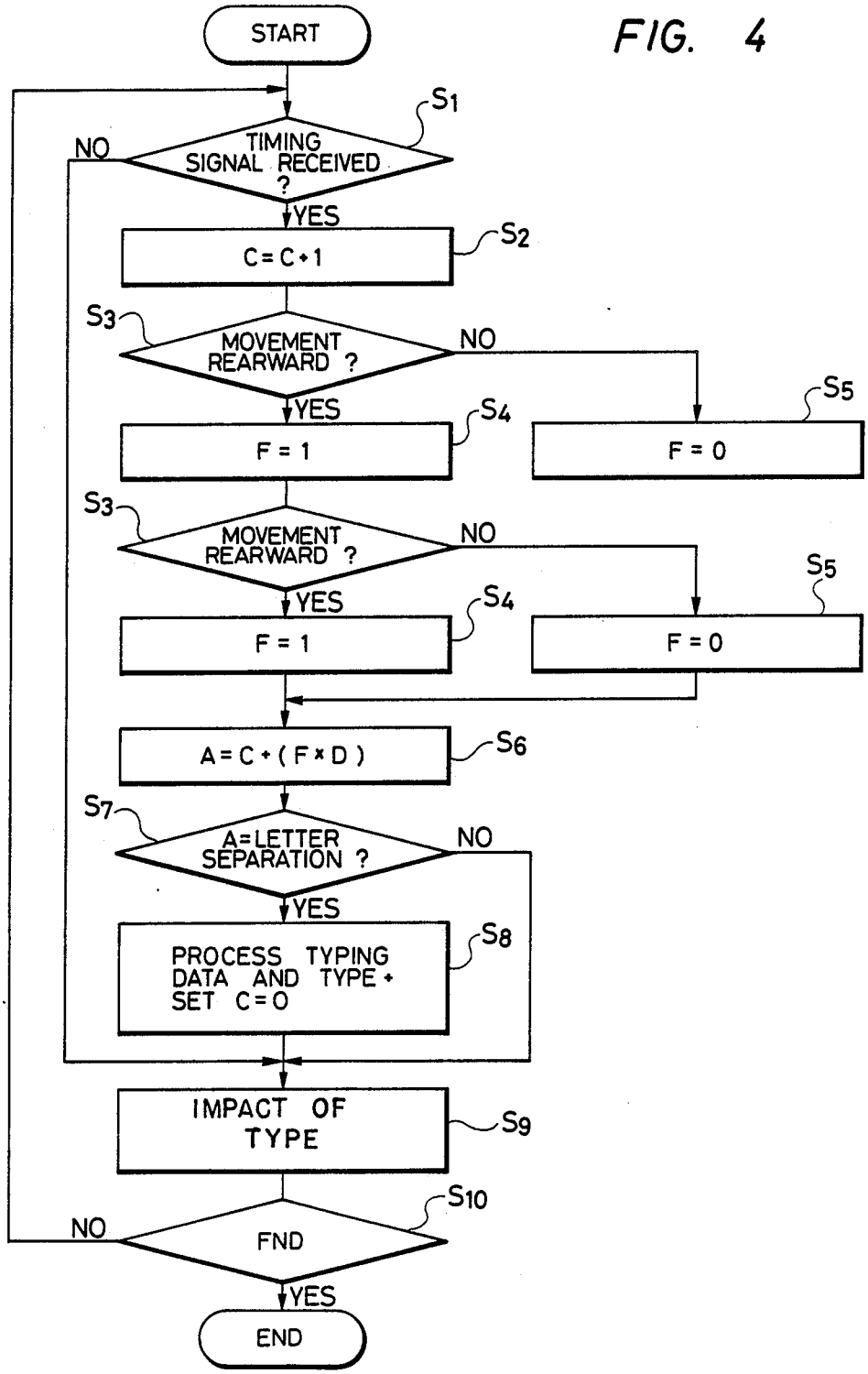
FIG. 4 is a flow chart explanatory of motion of the system of the invention.

The control 9 first determines whether a timing signal is produced in a step $S_1$ in FIG. 4. In step $S_2$ an addition of 1 is made to a counted value C in counter 8. In step $S_3$, the direction in which the head is moved is discriminated so that if the rearward movement is found, the head is moved to a step $S_4$ to have a typing direction flag F set to "1" whereas if forward movement is found, the head is moved to a step $S_5$ to set the typing direction flag F to "0". In a step $S_6$, the count stored in counter 8 C, together with F and D are employed to compute, "$C+(F\times D)$" which is compared to A, the letter separation. The letter "D" represents the electro-mechanical delay. When the answer is "yes" in step $S_7$, typing is carried and if the answer is "no" step $S_8$ is skipped. The timing signals generated are shorter than the actual typing distance as aforementioned, for example, at a distance of 1/720 inch. When the letters with the dots are typed at every 1/120 inch, a typing signal is produced whenever six typing timing signals are counted. On the other hand, when the letters with the dots are typed at every 1/180 inch, typing occurs whenever four typing timing signals are counted. Upon completion of steps $S_7$ and $S_8$, the head is moved to the step $S_9$ which is the impact of the type. Thereafter, discrimination is made whether or not the process is completed in step $S_{10}$. Then, the answer is "yes" to end or "no" to return to step $S_1$. In this manner, typing is initiated by timing earlier than the objective typing position to the direction in which the typing head is moved by the typing delay. This will correspond the typing positions to each other in to-and-fro motion as shown in FIG. 5.

As aforementioned, the reciprocative typing control system is constituted so that the typing timing signal is shorter than the actual spacing between characters, and that the position of the printed dots resulting from timing signals in the forward motion is shifted to be in vertical alignment with the position of printed dots in the rearward motion by the inherent typing delay derived from characteristics of the typing head in the control. Thus no adjustment is required in typing in a to-and-fro motion, and the control system may be applied with use of the linear scale.

What is claimed is:

1. A reciprocative typing control system comprising:

a type head driven reciprocally along a line for typing letters in both forward and rearward movements in response to a periodic typing signal following a delay said typing signals being spaced in accordance with the desired separation between adjacent letters;

means for producing a timing signal each time said head is driven a predetermined distance less than the separation between adjacent letters, said separation being equal to an adjustably predetermined number of timing signals and said delay being equal to a fixed number of timing signals;

means for counting said timing signals and means for resetting said counting means each time said typing signal is produced;

means for determining the direction of movement of said type head; and control means, operative in response to said counting means and to said direction determining means for producing said typing signal for typing a letter in the forward direction of said type head movement when the timing signals counted by said counting means equal said adjustably predetermined number and producing said typing signal for typing a letter in the rearward direction of said type head movement when the counted timing signals equal said adjustably predetermined number minus said number of timing signals equal to said delay whereby uniformly spaced typing is achieved regardless of the number of timing signals per typing signal and of the direction of type head movement during printing.

2. A method of operating a reciprocative typing control system comprising the steps of:

driving a type head reciprocally along a line to type letters in both forward and rearward movements in response to a periodic typing signal following a delay said typing signals being spaced in accordance with the desired separation between adjacent letters;

producing a timing signal each time said head is driven a predetermined distance less than the separation between adjacent letters, said separation being equal to an adjustably predetermined number of timing signals and said delay being equal to a fixed number of timing signals;

counting said timing signals and resetting said counting means each time said typing signal is produced;

determining the direction of movement of said type head; and producing by control means operative in response to said counting means and to said direction determining means said typing signal for typing a letter in the forward direction of said type head movement when the timing signals counted by said counting means equal said adjustably predetermined number and producing said type signal when for typing a letter in the rearward direction of said type head movement when the counted timing signals equal said adjustably predetermined number minus said number of timing signals equal to said delay whereby uniformly spaced typing is achieved regardless of the number of timing signals per typing signal and of the direction of type head movement during printing.

* * * * *